US005112474A

United States Patent [19]

Douglas

[11] Patent Number: 5,112,474

[45] Date of Patent: May 12, 1992

[54] SCREENING APPARATUS WITH TILTABLE VIBRATORY SCREEN

[76] Inventor: Patrick J. Douglas, 2 School Lane, Santon, Douglas, Isle of Man

[21] Appl. No.: 384,063

[22] Filed: Jul. 20, 1989

Related U.S. Application Data

[63] Continuation of Ser. No. 226,805, Aug. 1, 1988, abandoned.

[30] Foreign Application Priority Data

Jul. 31, 1987 [GB] United Kingdom ..... 8718161

[51] Int. Cl.[5] ..... B07B 1/46; B07B 1/28

[52] U.S. Cl. ..... 209/240; 209/245; 209/247; 209/255; 209/413; 209/420

[58] Field of Search ..... 209/233, 240, 241, 243-245, 209/247, 251, 255, 257, 311, 315, 317, 319, 320, 404, 405, 408, 409, 412, 413, 416, 420, 421; 198/311, 313, 314, 316.1, 360, 369, 535, 536

[56] References Cited

U.S. PATENT DOCUMENTS

| | | | |
|---|---|---|---|
| 966,294 | 8/1910 | Arps | 209/311 |
| 1,661,781 | 3/1928 | Whitnall | 209/247 |
| 1,840,029 | 1/1932 | Garbe | 209/416 |
| 1,846,668 | 2/1932 | Barber | 209/241 |
| 2,022,146 | 11/1935 | Ossing | 209/247 UX |
| 2,022,148 | 11/1935 | Ossing | 198/536 |
| 2,267,419 | 12/1941 | Oster | 209/241 |
| 2,922,510 | 1/1960 | Zetterlund | 209/241 X |
| 3,439,806 | 4/1969 | Kass et al. | 209/420 X |
| 4,058,198 | 11/1977 | O'Neill et al. | 198/314 X |
| 4,190,526 | 2/1980 | Bachand | 209/245 |
| 4,303,506 | 12/1981 | Finlay | 209/247 |
| 4,591,432 | 5/1986 | Hartl | 209/247 |

FOREIGN PATENT DOCUMENTS

| | | | |
|---|---|---|---|
| WO85/03652 | 8/1985 | European Pat. Off. . | |
| 1170227 | 5/1964 | Fed. Rep. of Germany | 209/247 |
| 2316005 | 1/1977 | France . | |
| 2332682 | 6/1977 | France | 209/420 |
| 1231808 | 5/1971 | United Kingdom | 198/313 |
| 1414786 | 11/1975 | United Kingdom | 198/314 |
| 1480688 | 7/1977 | United Kingdom | 209/420 |
| 2100692 | 1/1983 | United Kingdom | 198/311 |
| 2119290 | 11/1983 | United Kingdom | 209/245 |
| 2175559 | 12/1986 | United Kingdom | 209/420 |

*Primary Examiner*—Margaret A. Focarino
*Assistant Examiner*—Edward M. Wacyra

[57] ABSTRACT

There is disclosed a screening apparatus for screening particulate material and which comprises a base frame, an elevating conveyor adjustably mounted on the base frame and arranged to convey material from a loading station at or near a lower end of the conveyor to a discharge station at an upper end of the conveyor, a sub-frame adjustably mounted on the base frame and carrying a vibratory screen for receiving material falling from the conveyor, a drive mechanism for adjusting the position of the conveyor along a guided path of movement, and a coupling arrangement which couples the conveyor and the sub-frame together in such a way that adjustment of the position of the conveyor relative to the base frame is accompanied by corresponding adjustment of the position of the sub-frame relative to the base frame so that the vibratory screen can take up any required attitude to suit particular requirements and in which it is still able readily to receive material falling from the upper end of the conveyor.

8 Claims, 2 Drawing Sheets

SCREENING APPARATUS WITH TILTABLE VIBRATORY SCREEN

This is a continuation of application Ser. No. 226,805, filed Aug. 1, 1988, now abandoned.

FIELD OF THE INVENTION

This invention relates to a screening apparatus with a tiltable vibratory screen for screening particulate material, such as by separating coarser from finer parts of gravel, coal, crushed rock and similar particulate materials.

The present invention has been developed primarily, though not exclusively, in connection with a screening apparatus having a vibratory screen which is tiltable in order to encourage those constituants of the feed material which are too coarse to pass through the screen apertures to travel over the screen surface and then fall off at the lowermost edge.

BACKGROUND OF INVENTION

It will be readily apparant that the steepness of the slope of the upper screen surface will affect both the speed and the precision of the sieving process, since a more steeply tilted screen will cause the coarser particles to pass more rapidly across the screen surface, thus increasing the rate at which material may be fed to the screen, but simultaneously the particles will be afforded less opportunity to pass through the screen apertures, and therefore that fraction of the feed material which passes over the upper screen surface will contain some particles which otherwise could have passed downwardly through the screen apertures. It is therefore normal practice with such machines to make provision for adjustment of the screen slope angle, in order to enable the operative to optimise the rate of throughput and the precision of the sieving process with respect to each other.

A typical tiltable vibratory screen has a nest of two or more screens arranged in such a manner that material which passes through the uppermost and coarsest screen then falls under gravity upon the surface of a subsequent and finer screen. Therefore, it is necessary to provide a troughed belt conveyor or other means to elevate the unscreened material to a height necessary to feed the material so that it falls continuously upon the uppermost screen adjacent to its uppermost edge, whilst simultaneously providing adequate space or headroom beneath the lowermost edge of the lowermost screen, to accommodate suitable means for the separate collection and removal of the various separated fractions.

It will be apparent that the positions of the uppermost and/or the lowermost edges of the screens with conventional apparatus will be altered each time the angle of tilt of the screen assembly is adjusted, and hence it becomes necessary to adjust the relative positions of the feed to the screen assembly and the means for collecting the separated fractions, usually in the form of discharge collection chutes.

SUMMARY OF INVENTION

The present invention therefore seeks to provide an improved construction of screening apparatus in which there is automatic adjustment of the vibratory screen and the conveyor (when an altered attitude of screen is required), whereby material fed to the conveyor can be supplied by falling under gravity from the conveyor to the screen readily, for any required attitude adopted by the screen, without further adjustment being necessary. It would also be advantageous for this automatic adjustment to be able to take place while the apparatus is in operation, without interupting the flow of material through the apparatus.

According to the invention there is provided a screening apparatus for screening particulate material and comprising:

- a base frame;
- an elevating conveyor adjustably mounted on the base frame and arranged to convey material from a loading station at or near a lower end of the conveyor to a discharge station at an upper end of the conveyor;
- a sub-frame adjustably mounted on the base frame and carrying a vibratory screen arranged to receive material falling under gravity from the upper end of the conveyor;
- discharge means for discharging separate screened portions of the material after treatment by the vibratory screen;
- drive means for adjusting the position of the conveyor relative to the base frame;
- guide means for guiding the adjustment movement of the conveyor; and
- means coupling together the conveyor and the sub-frame in such a way that adjustment of the position of the conveyor relative to the base frame is accompanied by corresponding adjustment of the position of the sub-frame relative to the base frame such that the vibratory screen takes up an adjusted attitude, to suit any particular operating requirements, and in which attitude the screen remains located in a suitable position relative to the upper end of the conveyor to receive material falling under gravity therefrom.

Therefore, when it becomes necessary to adjust the attitude of the vibratory screen i.e. the inclination of its upper screening surface to the horizontal, to suit a particular material to be screened, it is only necessary to adjust the position of the conveyor, and the sub-frame and the screen automatically follow the adjustment of the conveyor so that the screen (when adjusted to the required new attitude) will remain able to receive the material falling under gravity from the upper end of the conveyor, despite the adjustment of all three of these components (the conveyor, the sub-frame and the screen) relative to the base frame.

Preferably, the sub-frame is pivotally mounted on the base frame, and conveniently this may be via a pivotal mounting at or near the lower end of the sub-frame.

The means coupling together the conveyor and the sub-frame may comprise a pivotal connection provided at or near the upper end of a carrying frame on which the conveyor is mounted, and to which an upper end of the sub-frame is connected.

The drive means for adjusting the position of the conveyor (and therefore also the sub-frame and the screen) preferably takes the form of a piston/cylinder device, such as a pneumatic ram.

The guide means may take any suitable form, and in one preferred embodiment comprises a crosshead guide which allows generally longitudinal movement of the carrier frame of the conveyor. However, by virtue of the pivotal connection between the conveyor frame and the sub-frame, there will also be a limited amount of generally pivotal movement of the conveyor frame relative to the cross-head guide.

Further, in one embodiment, it is preferred that the sub-frame is pivotally mounted on an upstanding pillar on the base frame, and the length of the sub-frame is considerably shorter than the carrier frame e.g. about half its length.

In another embodiment, the sub-frame is directly mounted on the base frame and has about the same length as the length of the carrier frame of the conveyor from the guide up to the pivotal connection, so that a generally isosceles triangle is formed.

In another arrangement of guide means, the conveyor frame is pivotally connected to the base frame by a toggle linkage which acts, in conjunction with the drive means (preferably a piston/cylinder device) so as to effect a generally rocking movement to the conveyor frame.

DESCRIPTION OF PREFERRED EMBODIMENTS

Figure 1:
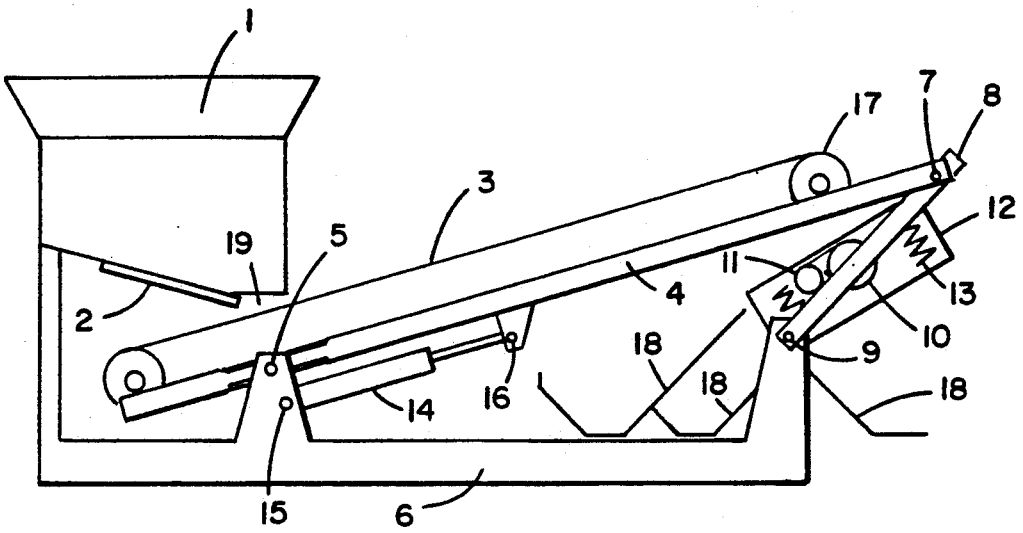
FIG. 1 is a side view of a first embodiment of screening apparatus according to the invention.

Referring now to FIG. 1 of the drawings, there is shown a screening apparatus for screening particulate material, such as gravel or similar granular material, which is caused to flow from a hopper 1 by operation of a reciprocating feeder 2, whereby a loading station is provided at which the material falls onto the top surface of a troughed belt conveyor 3.

The conveyor 3 is an elevating conveyor which is adjustably mounted upon base frame 6 of the apparatus, and is arranged to convey material from the loading station at or near a lower end of the conveyor to a discharge station at the upper end of the conveyor. The conveyor 3 is mounted upon a carrying frame 4 which is supported, adjacent to its lower end, by guide means in the form of a pair of cross-head type guides 5, arranged one on either side of the conveyor frame 4, and fixed to the base frame 6.

The upper end of the conveyor frame 4 is connected by a pivot 7 to the upper end of a sub-frame 8 which also is adjustably mounted on the base frame 6, and carries a vibratory screen which is arranged to receive material falling under gravity from the upper end of the conveyor 3.

The lower end of the sub-frame 8 is connected by a pivot 9 to an upstanding pillar on the base frame 6, and the sub-frame 8 carries bearings 10, and a drive motor 11, to support and drive a conventional flat screen box 12. Further support and guidance for the screen box 12 is provided by springs 13.

The attitude adopted by the screen box 12 will be adjusted according to operating requirements, depending upon the size and rate of feed of the particulate material.

Discharge/collection means is provided for receiving separate screened portions of the material, after treatment by the vibratory screen, and takes the form of suitably arranged collection chutes 18.

Drive means is provided for adjusting the position of the conveyor frame 4, and conveyor 3 carried thereby, relative to the base frame 6, and takes the form of a piston-cylinder 14 which acts between pivot 15 on the base frame 6 and a pivot 16 mounted on a bracket depending from the underside of the conveyor frame 4. The piston cylinder device 14 may comprise a hydraulic cylinder, or a pneumatic ram arrangement.

Upon actuation of the cylinder 14, this causes the frame 4 to move generally axially through the cross-head guides 5, thereby altering the distance between the guides 5 and the pivot 7, and also altering the angle of tilt of the sub-frame 8 and the screen box 12 carried thereby, without substantially altering the pre-set spacial relationships between the components of the apparatus as follows:

between the feeder 2 and the conveyor 3, at the position 19 where feeding takes place;

the conveyor head drum 17 and the uppermost edge of the screen box 12;

or the lowermost edge of the screen box 12 and the fixed collections chutes 18.

Thus, means is provided which couples together the conveyor 3 and the subframe 8 in such a way that adjustment of the position of the conveyor 3 relative to the base frame 6 is accompanied by corresponding adjustment of the position of the sub-frame 8 relative to the base frame 6 such that the vibratory screen (12) takes up an adjusted attitude, to suit any particular operating requirement, and in which attitude the screen remains located in a suitable position relative to the upper end of the conveyor 3 to receive material falling under gravity therefrom.

Figure 2:
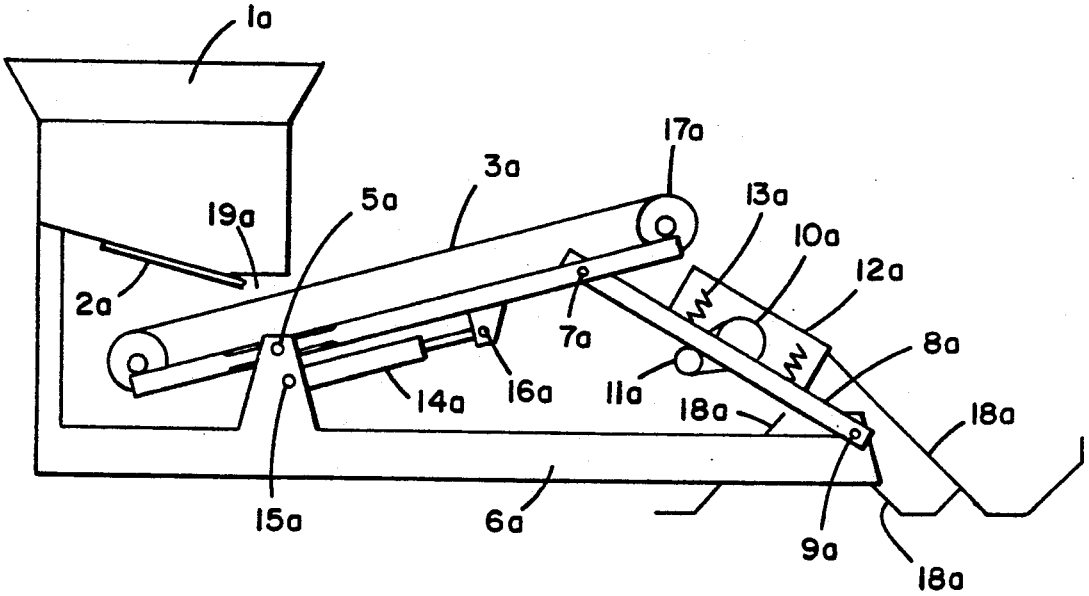
FIG. 2 is a side view of a modified embodiment of screening apparatus according to the invention.

An alternative embodiment is shown in FIG. 2, in which parts corresponding with those already described are designated by the same reference letters, but with the addition of the letter a. In this embodiment, the length of the sub-frame **8*a* is extended, as compared with the embodiment of FIG. 1 in which its length is less than one half of the length of the conveyor frame (4), such that the sub-frame 8*a* is of substantially the same length as the distance between the cross-head guides 5 and the pivot 7*a*. Also, the sub-frame 8*a* is mounted directly on the base frame 6*a***, and a generally isosceles triangular arrangement is provided.

The adjustment movement of the conveyor frame 4 is generally similar to that obtainable by the embodiment of FIG. 1, but there is a different arrangment of the screen box 12, as can be seen from FIG. 2, and also a different arrangement of the collecting chutes 18.

Figure 3:
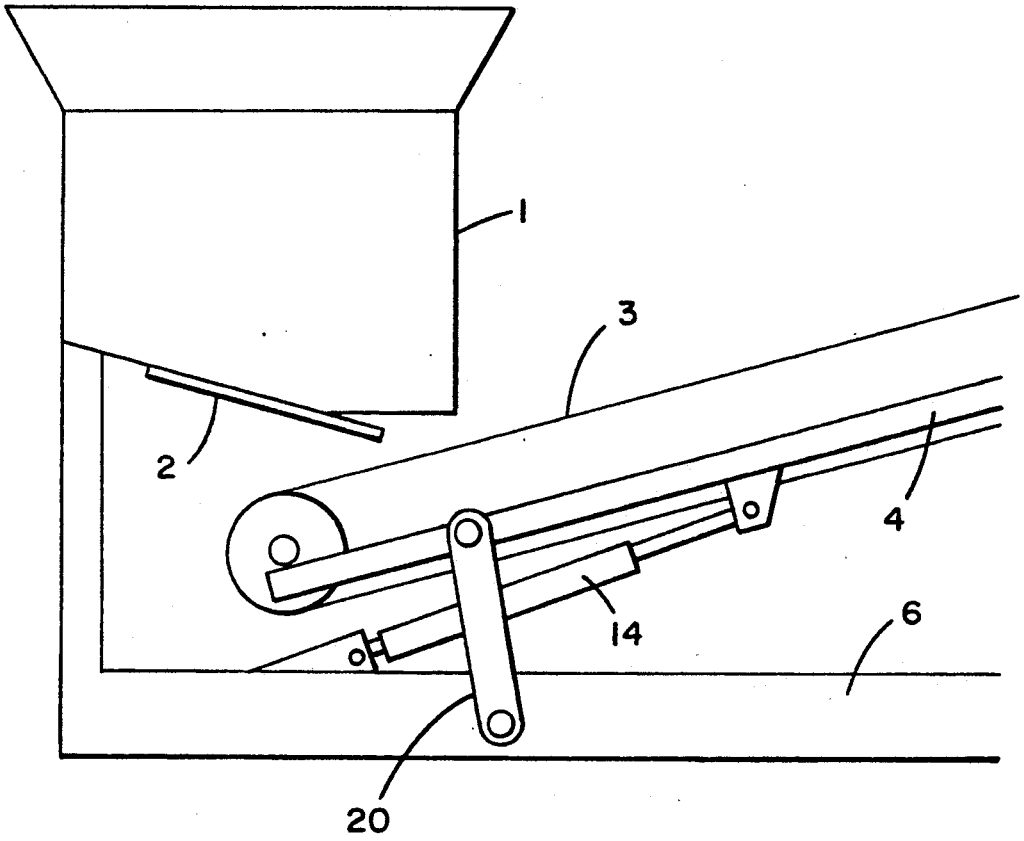
FIG. 3 is a side view, to an enlarged scale, illustrating an alternative means for mounting the lower end of a conveyor on a base frame of a screening apparatus according to the invention.

Finally, referring to FIG. 3, an alternative arrangment of guide means for the lower end of the conveyor frame 4 is illustrated. In the arrangement of FIG. 3, the conveyor frame 4 is pivotally connected to the base frame 6 by a toggle linkage in the form of a pair of link arms 20, and this linkage acts, in conjunction with the cylinder 14, so as to effect a generally rocking movement to the conveyor frame 4. Via the pivotal connection between the upper end of conveyor frame 4 (not shown) with the upper end of the sub-frame 8, corresponding adjustment movement takes place of the sub-frame 8 and the screen box 12, to follow the adjustment movement of the conveyor frame 4.

Thus, by suitably proportioning the linkage, it can be arranged that, as the conveyor angle is steepened by operation of the hydraulic cylinder 14, the distance between the underside of the feeder 2 and the surface of the upper run of the belt of conveyor 3 is increased, thereby maintaining a generous clearance between the material on the conveyor and the front edge of the hopper 1.

Although not shown in detail, the apparatus may be provided with additional conveyors and/or elevators to carry screened material away from the vicinity of the screening apparatus, and the base frame 6 may be mounted firmly on a foundation, or arranged to be mounted on wheels or tracks.

The disclosed embodiment of screening apparatus according to the invention provide an assembly which takes the form of a triangle having as sides;

the sloping conveyor;

the screen sub-frame; and the base frame respectively.

Since the effective length of the conveyor frame relative to the other two sides of the triangle may be altered by adjusting its position in its guides, the proportions of the triangle may be changed, causing the angle of tilt of the screen sub-frame to be altered while simultaneously maintaining, through the pivotal connections, the necessary spacial relationships. Thus, on the one hand, the spatial relationship is maintained between the head end of the conveyor and the upper edge of the screen box, and on the other hand the lower edge of the screen box and the guiding and collecting chutes, while simultaneously keeping substantially constant the spatial relationship between the material feeder and the surface of the lower end of the elevating conveyor.

I claim:

1. A screening apparatus for screening particulate material and comprising:

a base frame;

an elevating conveyor arranged to convey material from a loading station at or near a lower end of the conveyor to a discharge station at an upper end of the conveyor;

a conveyor carrying frame adjustably mounted on the base frame and arranged so as to be capable of moving the conveyor generally lengthwise relative to the mounting of the carrying frame on the base frame;

a sub-frame pivotally mounted on the base frame and carrying a vibratory screen arranged to receive material falling under gravity from the upper end of the conveyor;

discharge means for discharging separate screened portions of the material after treatment by the vibratory screen;

drive means for adjusting the position of the conveyor generally lengthwise relative to the mounting of the carrying frame on the base frame;

guide means for guiding the movement of the conveyor carrying frame; and, a direct pivotal connection between the sub-frame and the conveyor carrying frame arranged so that lengthwise adjustment of the conveyor relative to the mounting of the carrying frame on the base frame is accompanied by pivotal adjustment of the sub-frame relative to the base frame such that the vibratory screen takes up an adjusted attitude, to suit any particular operating requirement, and in which said vibratory screen receives material falling under gravity from the upper end of the conveyor.

2. A screening apparatus according to claim 1, in which the sub-frame has a pivotal mounting at or near its lower end by means of which it is mounted on the base frame.

3. A screening apparatus according to claim 1, in which said direct pivotal connection is provided at or near the upper end of said carrying frame on which the conveyor is mounted, and to which an upper end of the sub-frame is connected.

4. A screening apparatus according to claim 1, in which said drive means comprises a piston/cylinder device.

5. A screening apparatus according to claim 1, in which the guide means comprises a crosshead guide mounted on the base frame and arranged to allow generally longitudinal movement of the carrying frame for adjustment of the conveyor.

6. A screening apparatus according to claim 5, in which the sub-frame is pivotally mounted on an upstanding pillar on the base frame, and the length of the sub-frame is considerably shorter than the carrying frame.

7. A screening apparatus according to claim 5, in which the sub-frame is directly mounted on the base frame and has approximately the same length as the length of the carrying frame from the guide up to the direct pivotal connection, so that a generally isosceles triangle is formed.

8. A screening apparatus according to claim 1, in which the guide means comprises a toggle linkage which pivotally connects the carrying frame to the base frame and which is operable, in conjunction with the drive means,. so as to effect a generally rocking movement to the carrying frame.

* * * * *